US007634879B2

(12) United States Patent
Trotter

(10) Patent No.: US 7,634,879 B2
(45) Date of Patent: Dec. 22, 2009

(54) STRUCTURAL SUPPORT SYSTEMS AND METHODS TO REINFORCE LINTEL SUPPORT SYSTEMS

(76) Inventor: William Clay Trotter, 2614 Chestnut Dr. North, Doraville, GA (US) 30360

( * ) Notice: Subject to any disclaimer, the term of this patent is extended or adjusted under 35 U.S.C. 154(b) by 291 days.

(21) Appl. No.: 11/682,330

(22) Filed: Mar. 6, 2007

(65) Prior Publication Data

US 2008/0216423 A1 Sep. 11, 2008

(51) Int. Cl.
*E04C 3/02* (2006.01)

(52) U.S. Cl. ..... 52/204.2; 52/831; 52/846

(58) Field of Classification Search ..... 52/204.1, 52/204.2, 73, 293.1, 210, 261, 291, 474, 52/573, 873, 831, 846, 836
See application file for complete search history.

(56) References Cited

U.S. PATENT DOCUMENTS

| | | | | |
|---|---|---|---|---|
| 1,498,526 | A * | 6/1924 | O'Sullivan | 52/831 |
| 1,749,687 | A * | 3/1930 | Anderson | 52/196 |
| 3,708,917 | A | 1/1973 | Streeter | |
| 3,815,943 | A | 6/1974 | Hass | |
| 3,891,021 | A | 6/1975 | Geoffrey | |
| 4,513,554 | A | 4/1985 | Johnson et al. | |
| 4,996,795 | A | 3/1991 | Niswonger | |
| 5,205,096 | A | 4/1993 | Pace | |
| 5,331,786 | A | 7/1994 | Lippert | |
| 5,337,520 | A | 8/1994 | Uribe | |
| 5,371,970 | A | 12/1994 | Ganikon | |
| 5,706,877 | A | 1/1998 | Grisham et al. | |
| 6,112,464 | A | 9/2000 | Grisham et al. | |
| 6,389,762 | B2 | 5/2002 | Le Poire | |
| 6,543,192 | B1 * | 4/2003 | Parker, Jr. | 52/204.2 |
| 6,560,938 | B1 | 5/2003 | Powers, Jr. | |
| 6,586,085 | B1 | 7/2003 | Jella | |
| 2002/0108325 | A1 * | 8/2002 | Hulls et al. | 52/204.1 |
| 2005/0284045 | A1 * | 12/2005 | Smith | 52/204.2 |

* cited by examiner

*Primary Examiner*—Robert J Canfield
*Assistant Examiner*—Patrick Maestri
(74) *Attorney, Agent, or Firm*—Troutman Sanders LLP; James H. Yancey, Jr.

(57) ABSTRACT

Structural support systems and methods are provided to reinforce lintel support systems. According to some embodiments, a reinforcement system to reinforce an elongated load bearing member having opposing ends and supporting a load can comprise an elongated reinforcing member having a first portion and a second portion. The first portion can be disposed beneath the load bearing member between the opposing ends of the load supporting member and have a length substantially equal to the length of the load bearing member. The second portion can have length greater than the first portion. Also, the second portion can extend in a substantially normal direction from the first portion and be spaced apart from the load bearing member. The second portion can be securedly fixed in a substantially static position to support the first portion disposed beneath the load bearing member. In one configuration, the second portion can be fixed to a header associated with a lintel support system. Other embodiments are also claimed and described.

16 Claims, 4 Drawing Sheets

STRUCTURAL SUPPORT SYSTEMS AND METHODS TO REINFORCE LINTEL SUPPORT SYSTEMS

TECHNICAL FIELD

The various embodiments of the present invention relate generally to structural support systems and methods, and more specifically, to systems and methods to reinforce the structural supporting systems of garages, windows, and other openings utilizing a lintel support structure.

BACKGROUND

The post and lintel construction technique (also called the post and beam technique) is commonly utilized when building homes and other such structures. This technique is a simple, yet effective construction technique and is thus used by many architects and builders to support a load above an opening. In the post and lintel technique, two vertical members (or the posts) support a horizontal member (or the lintel) at opposing ends of the horizontal member. The famous Stonehenge monument is a classical example of the post and lintel technique.

The post and lintel technique is commonly used to support loads over door, garage, and window openings. For example, FIG. 1 illustrates two vertical posts 105, 110 supporting a horizontal lintel 115 in a structural support system 100. The structural support system 100 is utilized to support a load 120 disposed generally above the horizontal lintel 115. The structural support system 100 can be configured in many sizes to accommodate an appropriate opening area 125 for a door, garage, or window opening. As evidenced by FIG. 1, the structural support system 100 is versatile, easily configurable, and simple; and for these reasons is still used in many of today's construction projects.

While the post and lintel construction technique is widespread and used considerably, it does suffer from certain drawbacks. For example, one drawback to the post and lintel technique is the limited weight that can be supported by the horizontal lintel and the distances required between vertical posts to ensure that the horizontal member is sufficiently supported. Also, as homeowners modify home space above lintel supported openings (such as attic over garage bonus rooms) this increased load may be too much as an installed lintel may not be designed to carry such an increased load. Another drawback is that the horizontal member can sag or develop an arch if not properly supported or if the post and lintel technique is not properly designed.

For example, as illustrated in FIG. 1, horizontal lintel 115 may sag in the direction of arrow 130 due to a heavy load or inadequate support from vertical posts 105, 110. As one might imagine, failure of the horizontal lintel 115 can lead to disastrous results due to the load 120 collapsing the lintel 115 and possibly even harm those passing through openings supported by a structurally unsound lintel. In addition, faulty lintels can cause damage to the surrounding structural or aesthetic components. For example, faulty or sagging lintels used in home construction can cause surrounding bricks to crack, mortar joints to fail, stucco exteriors to develop stress cracks, and exterior siding to lose a plumb finish.

Other issues may also lead to a faulty post and lintel system. For example, construction workers may not fully appreciate a load that a lintel will carry during use and therefore install a post and lintel system not capable of carrying a load. Such an under appreciation of a future load can therefore cause failure of a lintel. Issues such as appropriate sizing of components of a post and lintel system can lead to a faulty post and lintel support system, especially when a lintel is overspanned (e.g., not adequately supported by posts) or undersized.

Those able to determine the existence of a faulty post and lintel support system have sometime been able to remedy the faulty lintel situation. Obviously learning about a faulty system before the onset of serious damage enables the owner of a structure to correct the problem before much damage occurs. Others who do not detect such problems, however, are usually forced to spend extensive resources for major renovation work.

In light of these issues, conventional solutions exist that have been used to correct faulty post and lintel construction techniques by reinforcing an existing lintel. For example, U.S. Pat. No. 6,543,192 to Parker, which is incorporated herein by reference, discloses a lintel support brace. Parker's lintel support brace is a two piece brace that attaches to a header. The bottom piece of Parker's brace extends beneath a lintel to support a lintel and transfer the lintel's load to the header. Other methods to remedy a sagging lintel include positioning one or more intermediary vertical posts between existing vertical posts to add addition support.

While serving their respective purposes, the above conventional solutions have associated drawbacks. For example, the addition of additional vertical supports, while effective, can alter the area of an opening, such as a homeowner's garage. This could prove troublesome if the additional vertical supports were accidentally knocked out of position; thus, this solution decreases the use of an opening. Also, Parker's lintel support brace is a two-piece system that requires removal of material to gain access to an opening's header. This requirement creates extra demolition and installation work since both sides of the header must be accessed to install Parker's brace. Also Parker's lintel support brace transfers load and stress to a header and at the same time does not increase the load carrying capability of the header. In some instances, this may cause a header to fail. In addition, Parker's brace is only applied as a spot relief and does not run the entire length of the lintel nor does Parker's brace add any additional vertical post support to the lintel.

Accordingly, there is a great need for improved structural support systems and methods that overcome the above mentioned and other drawbacks associated with conventional lintel support systems. In addition, there is a need for structural support systems and methods to reinforce lintel support systems that are easily installed and are low-cost methods to reinforce existing lintel support systems. It is to the provision of such structural support systems and methods to reinforce lintel support systems that the various embodiments of the present invention are directed.

BRIEF SUMMARY

Broadly described, the various embodiments of the present invention enable reinforcement of load bearing members used to support a load generally disposed above an opening. Such openings may include, for example, home car garages and home window openings, and embodiments of the present invention can be used to support structural loads located above home car garages and home window openings by reinforcing an existing load carrying system. In accordance with some embodiments of the present invention, a system to reinforce an elongated load bearing member having opposing ends and supporting a load can comprise an elongated reinforcing member having a first portion and a second portion. In some embodiments, the load bearing member can be a lintel positioned above an opening.

The first and second portions of the reinforcement system's elongated reinforcing member can be used to support a load bearing member, such as a lintel. The first portion can be disposed beneath the load bearing member between the opposing ends of the load supporting member and have a length substantially equal to the length of the load bearing member. The second portion can have length greater than the first portion. Also, the second portion can extend in a substantially normal direction from the first portion and be spaced apart from the load bearing member. The second portion can be securedly fixed in a substantially static position to support the first portion disposed beneath the load bearing member.

Other aspects and features of embodiments of the present invention will become apparent to those of ordinary skill in the art, upon reviewing the following description of specific, exemplary embodiments of the present invention in conjunction with the accompanying figures.

DETAILED DESCRIPTION OF PREFERRED & ALTERNATIVE EMBODIMENTS

Figure 1:
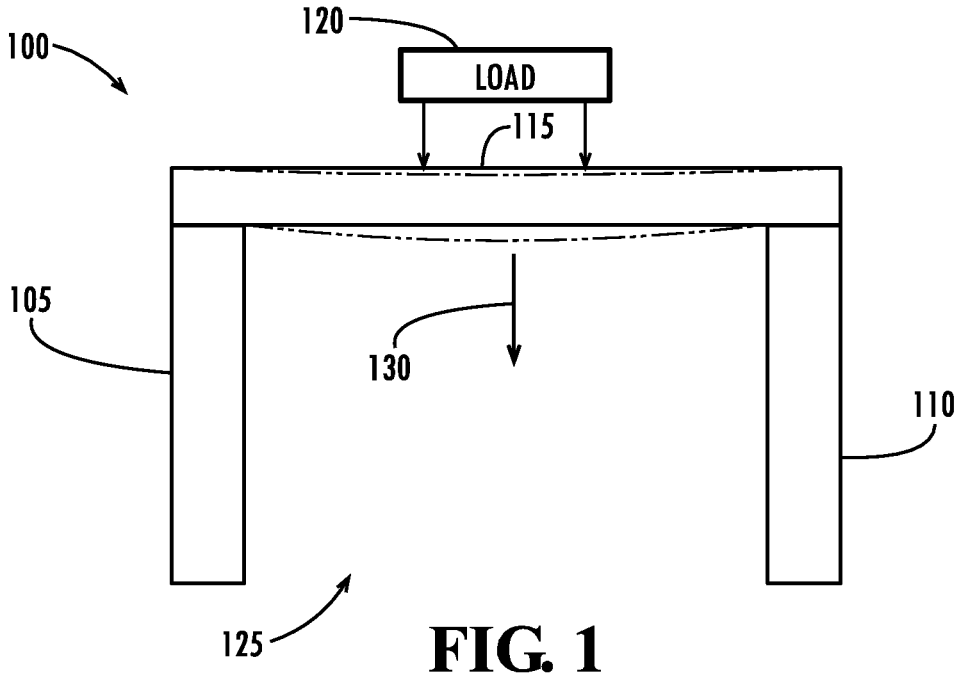
FIG. 1 (PRIOR ART)
FIG. 1 illustrates a perspective view of a conventional lintel and post support system.

Referring now to the figures, wherein like reference numerals represent like parts throughout the several views, exemplary embodiments of the present invention will be described in detail. Throughout this description, various components may be identified as having specific values or parameters, however, these items are provided as exemplary embodiments. For example, it should be understood that while exemplary embodiments of the present invention are discussed herein with reference to home garage openings, embodiments of the present invention can be used to reinforce and support other load bearing members utilized in numerous other structural openings. In addition, embodiments of the present invention can be used to reinforce existing load carrying members or used during the construction of new load carrying members. Thus, the exemplary embodiments do not limit the various aspects and concepts of the present invention as many comparable parameters, sizes, ranges, and/or values may be implemented.

Figure 2:
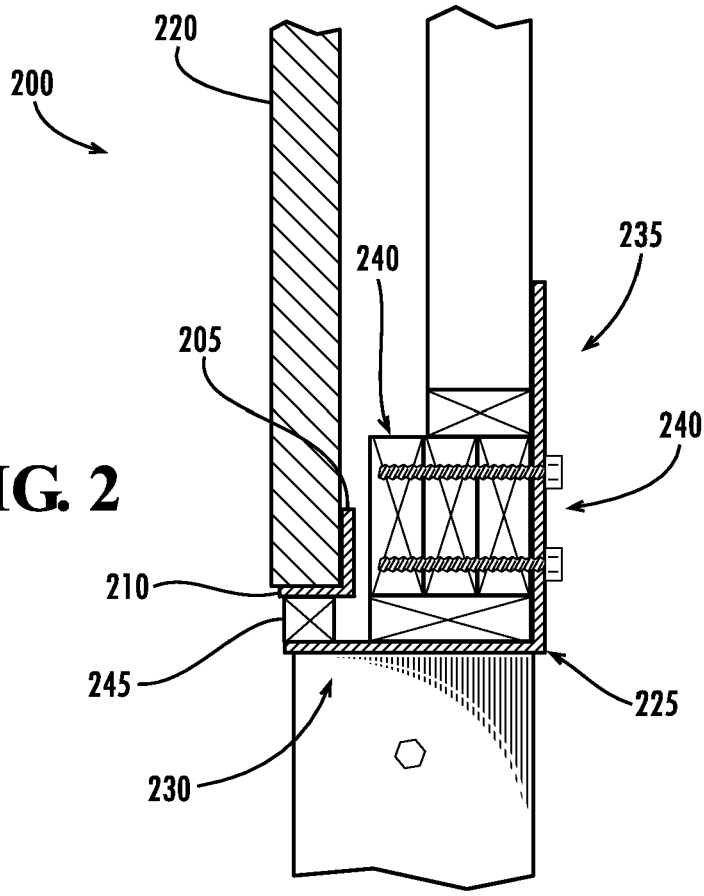
FIG. 2 illustrates a cross-sectional view of a lintel reinforcement system according to some embodiments of the present invention.
Figure 4:
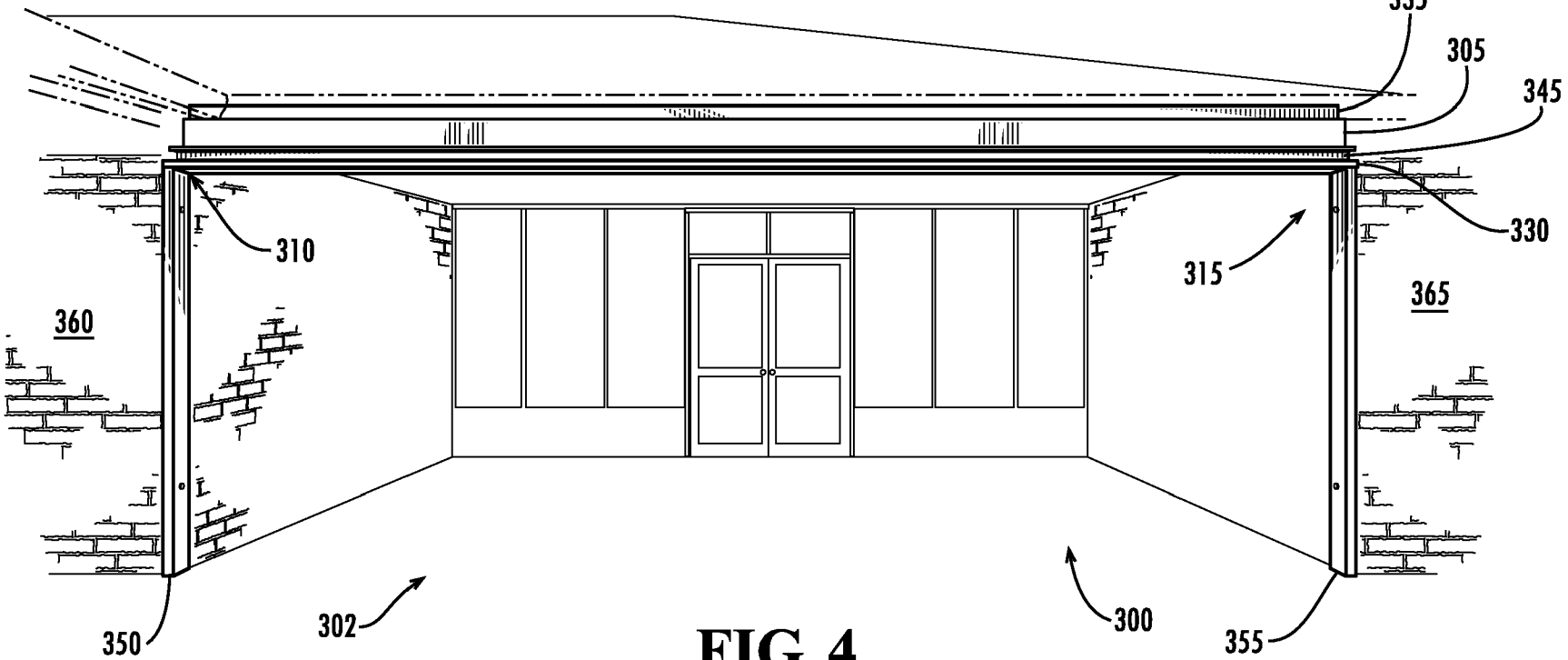
FIG. 4 illustrates a perspective rear view of a lintel reinforcement system according to some embodiments of the present invention.

Turning now to FIG. 2, FIG. 2 illustrates a cross-sectional view of a lintel reinforcement system 200 according to some embodiments of the present invention. As shown, the system 200 reinforces an elongated load bearing member 205 having opposing ends supporting a load 220. One such opposing end is first opposing end 210 (FIG. 4 illustrates opposing ends of a load bearing member). The load 220 may include brickwork or other items placed above an opening. The elongated load bearing member 205 is sometimes referred to herein as a lintel. The system 200 comprises an elongated reinforcing member 225 having a first portion 230 and a second portion 235. The load bearing member 205 can be a lintel positioned above an opening such as a door, garage, or window.

The elongated reinforcing member 225 can have multiple portions to enable it to reinforce and add structural support to a lintel 205 (or other existing load bearing member). Indeed, the elongated reinforcing member 225 can have a first portion 230 and a second portion 235. The first portion 230 is preferably disposed beneath the load bearing member 205. Also, the first portion 230 can be positioned between the opposing ends 210, 215 of the load bearing member 205 and have a length substantially equal to the length of the load bearing member 205. Advantageously, having a length approximately the same as the load bearing member 205 enables the elongated reinforcing member 225 to support the load bearing member 205 substantially along the entire length of the load bearing member 205.

The first and second portions 230, 235 can also have other characteristics according to embodiments of the present invention. For example, the second portion 235 can have a length greater than the length of first portion 230. That is, as shown in FIG. 2, the first portion 230 extends beneath the lintel 205 a shorter distance than the second portion 235 extends away from the first portion. In the various embodiments, the lengths and thicknesses of the first portion 230 and the second portion 235 can vary as desired. For example, the first portion 230 and the second portion 235 can have a thickness ranging from approximately one quarter of an inch to approximately one inch and a length ranging from approximately eight inches to sixteen inches. Advantageously, dimensions in these ranges provide configurations enabling effective transfer of load and stress of the lintel 205 to the elongated reinforcement member 225 so that the elongated reinforcement member 225 reinforces the lintel 205. Further, this configuration assists to ensure that the lintel 205 does not rotate or shift due to carrying the load 220. The first and second portions 230, 245 are preferably made of steel or another rigid material capable of carrying a load and supporting the lintel 205.

The configuration of the elongated reinforcing member 225 can also have various characteristics. For example, the first portion 230 and the second portion 235 can be positioned in an approximate right angle configuration such that the second portion 235 extends in a substantially normal direction from the first portion 230. In this configuration, the elongated reinforcing member 225 can have an "L" shaped cross section. Also, the second portion 235 can be spaced apart from the load bearing member 205 and securedly fixed in a substantially static position. For example, the second portion 235 can be affixed or attached to a header 240 associated with the lintel 205, as shown in FIG. 2. Advantageously, this configuration enables the elongated reinforcing member 225 to support the lintel 205 by transferring load from across the length of the lintel 205 to the full length of the header 240.

When used to structurally reinforce an existing load bearing member 205, the system 200 may be implemented as follows. A user may first identify that a lintel 205 is faulty and shows signs of sagging or other signs of failure. Following identifying a faulty lintel 205, an elongated reinforcing member 225 can be positioned proximate the lintel 205. Since the elongated reinforcing member 225 can have a length approximately the same as the lintel 205 (or the as the opening disposed below the lintel 205), the elongated reinforcing member 225 can add structural reinforcement across the length of the opening. Thus, the elongated reinforcing member 225 can be positioned beneath the lintel 205 so that the first portion 230 of the lintel 225 creates a reinforcing shelf to carry the lintel 205 across its length (or across the length of the opening disposed below the lintel 205).

The second portion 235 of the lintel 205 can also be spaced apart from the lintel 205 and positioned along the exterior of material adjacent to the lintel 205. For example, as shown in FIG. 2, the second portion 235 is spaced apart from the lintel 205 and positioned along the outside of header 240. Advantageously, this configuration enables the elongated reinforcement 225 to be placed on the exterior of an existing structure without having to alter or remove any portions of the existing structure. For example, as depicted in FIG. 2, the elongated reinforcement member 225 is secured directly to the exterior of header 240 and associated exterior wall finish with mounting bolts. In other embodiments, other mounting mechanisms may be used, including screws, clamps, adhesives and the like.

As shown in FIG. 2, the support system 200 can also include other features. One such feature is a spacer 245. The spacer 245 is generally disposed between the lintel 205 and the first portion 230. The spacer 245 can be integrated with the first portion 230 or can be a separate component to allow for positioning of the spacer 245 between the lintel 205 and first portion 230. The spacer can have various shapes and sizes. For example its length may be approximately equal to the lintel and thereby run the length of the lintel. Alternatively, the spacer 245 can comprise several spacer components spaced apart along the length of the lintel. Still yet, the spacer 245 may have a generally square or rectangular cross sectional area although other geometric configurations can be utilized. Also, the spacer 245 is preferably constructed of materials such as steel or other rigid materials. If a separate component, the spacer 245 may be coupled to or bonded to the first portion 230. Advantageously, the spacer 245 enables a tight fit (or tight mechanical coupling) between the lintel 205 and the first portion 230 to enable the support system to contact and support the lintel 205. Other advantageous features of embodiments of the present invention are discussed below.

Figure 3:
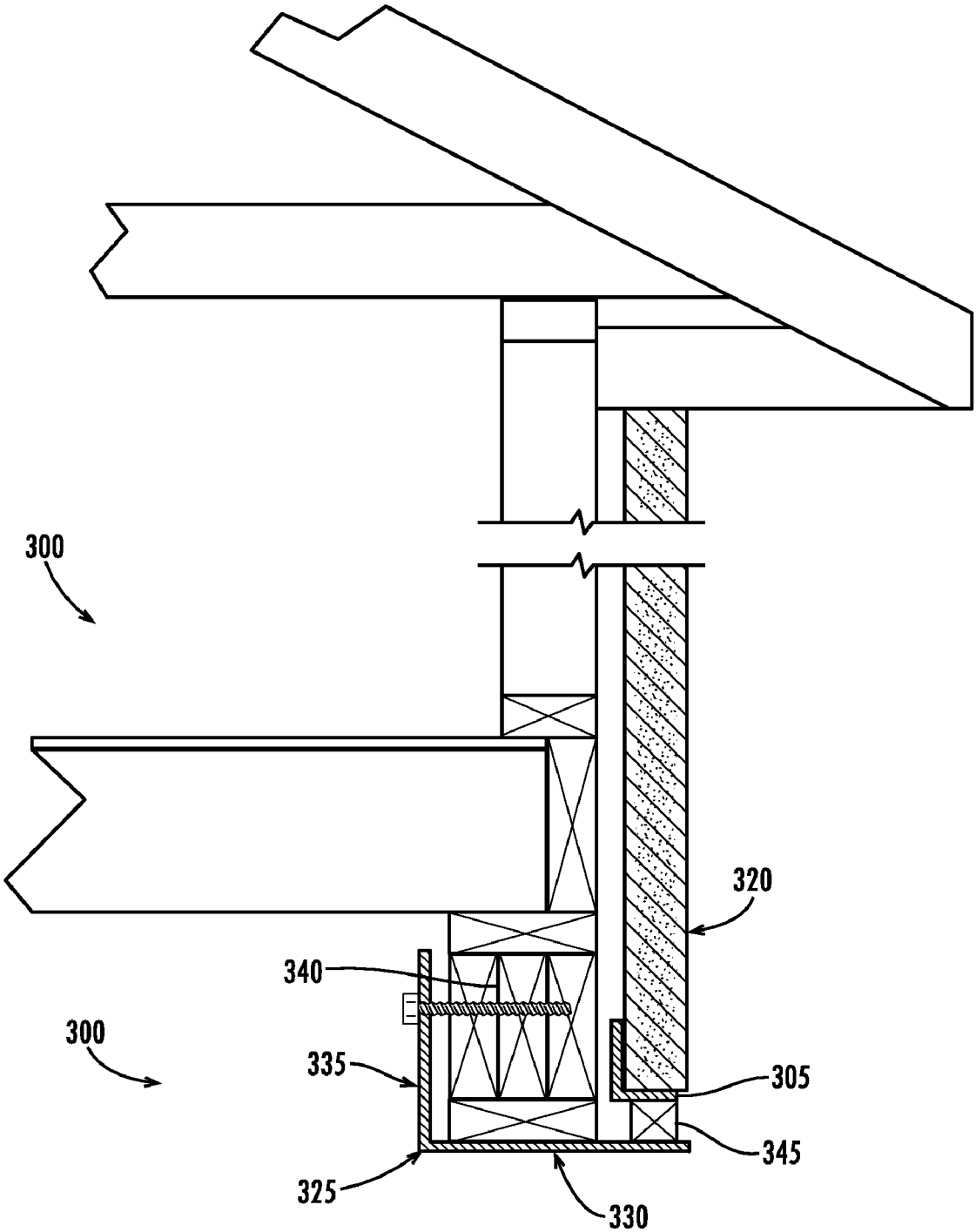
FIG. 3 illustrates a cross-sectional view of a lintel reinforcement system according to some embodiments of the present invention.

FIG. 3 illustrates a cross-sectional view of a lintel reinforcement system 300 according to some embodiments of the present invention. In this particular embodiment, the system 300 is used to reinforce a lintel 305 supporting a load 320, which may include a home's exterior brickwork. The system 300 generally includes a horizontal reinforcement member 300 and two vertical members 350, 355 (see FIG. 4). Since the lintel reinforcement system 300 can be directly applied onto exterior surfaces a user need not remove any materials to gain access to a header 340. That is, a user can position the horizontal reinforcement member 325 directly onto the exterior of an existing area and secure the horizontal reinforcement member 325 to the header 340.

Then, a user can then position the vertical members 350, 355 (as shown in FIG. 4) at each end of the horizontal reinforcement member 325 to support the horizontal reinforcement member 325. The vertical members 350, 355 can be applied directly to an existing exterior periphery of an opening and secured in place with bolts or other securing mechanisms. The vertical members 350, 355 are preferably disposed between and in contact with (directly or indirectly) the horizontal reinforcement member 325 and a surface. The surface can be the ground, a driveway surface, or other suitable load bearing surface capable of withstanding weather effects to ensure its load bearing capabilities are not affected. Advantageously, this configuration enables the vertical members 350, 355 to support the horizontal reinforcement member 325 such that the header 340 does not have to carry and support the full load of the horizontal reinforcement member 305. In addition, this configuration also advantageously serves to at least partially transfer some of the load 320 to the vertical members 350, 355 (see FIG. 4).

Thus, the reinforcement system 300 provides an internal reinforcement frame placed within an existing lintel support system to transfer load and stress from an existing lintel to the internal reinforcement frame. Due to the configuration of the reinforcement system 300, the load 320 applied to the lintel 305 is transferred along the full length of the lintel 305 to the horizontal reinforcement member 325 thereby providing an optimal reinforcement system.

FIG. 4 illustrates a perspective view of the lintel reinforcement system 300. As illustrated in this embodiment, the system 300 is reinforcing the lintel 305 disposed above a home's garage 302. As shown, the lintel 305 is supporting a load 320 above the garage opening 302, and the lintel 305 is placed proximate the header (not shown) of the garage opening 302. The lintel reinforcement system 300 can be configured as a reinforcement frame system to reinforce the lintel 305 and to support the load 320. The reinforcement frame system 300 can comprise an elongated horizontal member 325 and a pair of vertical support members 350, 355. As shown, the elongated horizontal member 325 has a length substantially equal to the garage opening 302.

The elongated horizontal member 305 can also comprise a first portion 330 and a second portion 335. The first portion 330 of the elongated horizontal member 325 is preferably positioned proximate the lintel 305 to carry the lintel 305 and the load 320 along the length of the opening 302. The second portion 335 of the elongated horizontal member 305 is spaced apart from the lintel 305 and positioned proximate the header 340. Also, the second portion 335 is preferably adapted to be securedly affixed to the header 340 along the length of the header 340. For example, the elongated horizontal member 305 can have various apertures (not shown) across the length of the second portion 335 allowing the second portion 335 to be attached to the header 340.

As mentioned above, the system 300 also comprises vertical support members 350, 355. The vertical support members 350, 355 can be positioned at opposing ends 310, 315 of the opening 302. Also, the vertical support members 350, 355 can be disposed between the elongated horizontal member 325 and a surface. The surface can be the ground, a driveway, the bottom surface of a garage, or other such surface. Preferably, the vertical support members 350, 355 can be secured to at least a portion of the periphery of the opening. For example, the opening 302 may be defined by sidewalls 360, 365 and the vertical support members 350, 355 can be attached to the sidewalls 360, 365. Attachment can be made with bolts or other such securing mechanisms.

As shown in FIG. 4, the reinforcement frame system 300 can include additional features. For example, preferably a spacer 345 is disposed between the first portion 330 of the elongated horizontal member 325 and the lintel 305 along the length of the lintel 305. The second portion 330 can have a length greater than the length of the header 340. Also, the first portion 330 of the elongated horizontal member 325 can have a thickness less than about one inch. The vertical support members 350, 355 can have a thickness of less than about two inches. Still yet, the elongated horizontal member 325 can have a generally "L" shaped configuration.

Figure 5:
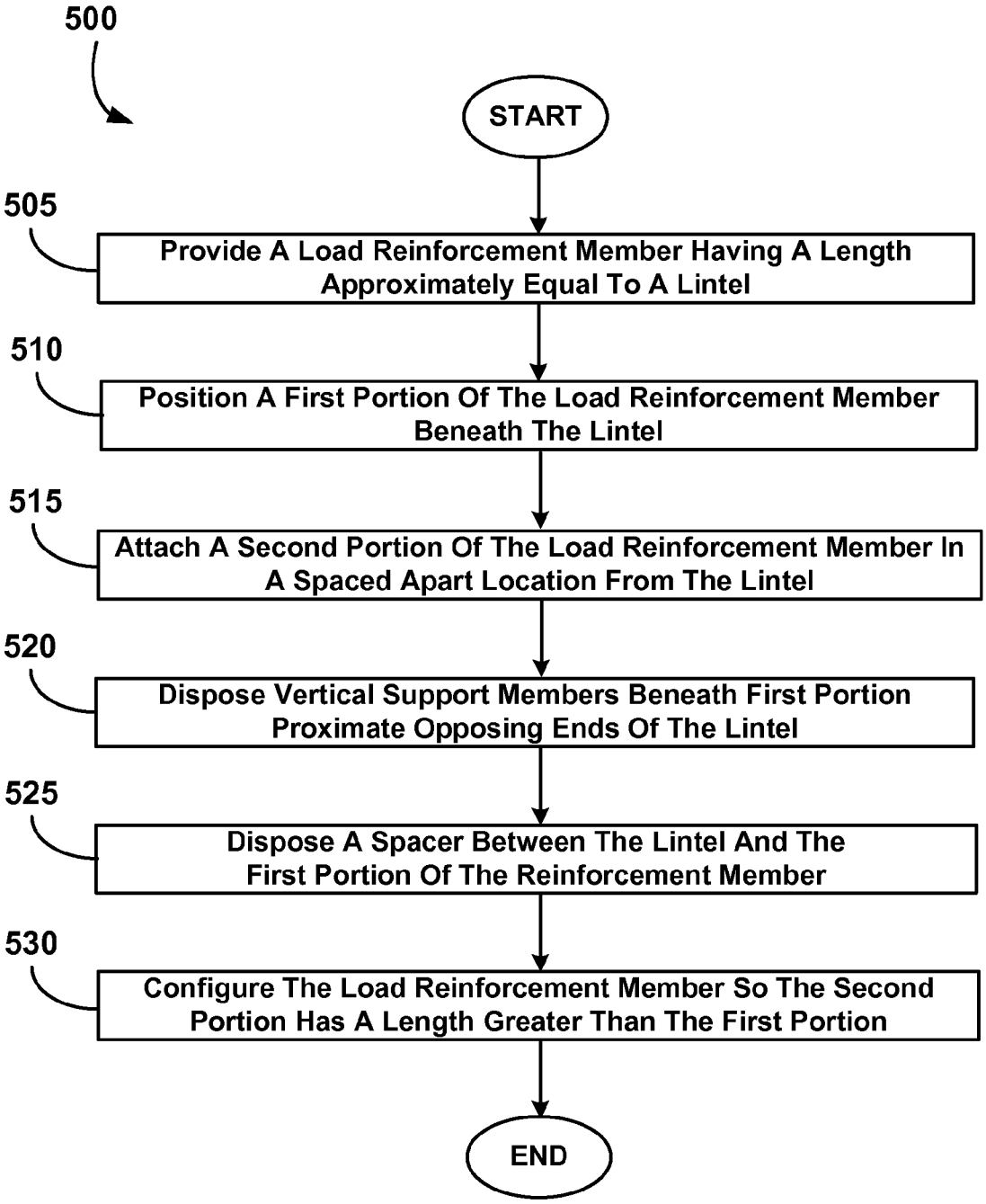
FIG. 5 illustrates a method of reinforcing a lintel supporting a load according to some embodiments of the present invention.

FIG. 5 illustrates a method 500 of reinforcing a lintel (or other load bearing member) supporting a load according to some embodiments of the present invention. According to some method embodiments, the present invention can be used to reinforce existing lintel support systems or used in new construction projects. Those skilled in the art will understand that the method 500 is only one method embodiment of the present invention and that the method 500 can have various steps or be performed in various orders relative to the order illustrated in FIG. 5 and described below.

The method 500 can initiate at 505 where a load reinforcement member having a length approximately equal to the load bearing member is provided. Next at 510, a first portion of the load reinforcement member can be positioned beneath the load bearing member. Also, a second portion of the load reinforcement member can be secured in a spaced apart position from the load bearing member at 515.

The method 500 can also include other features. For example, the method 500 may further comprise disposing a pair of vertical support members beneath the first portion of the load reinforcement member proximate opposing ends of the load bearing member at 520. In addition, the method 500 may also include disposing a spacer between the load bearing member and the first portion of the reinforcement member at 525. Still yet, the method 500 may also include configuring the load reinforcement member such that the second portion has a length greater than the first portion at 530. And the method 500 can also comprise statically affixing the second portion of the load bearing member to a header at 535, wherein the header located proximate the load bearing member.

The embodiments of the present invention are not limited to the particular exemplary embodiments, process steps, and materials disclosed herein as such embodiments, process steps, and materials may vary somewhat. Moreover, the terminology employed herein is used for the purpose of describing exemplary embodiments only and the terminology is not intended to be limiting since the scope of the various embodiments of the present invention will be limited only by the appended claims and equivalents thereof.

Thus, while the various embodiments of this invention have been described in detail with particular reference to exemplary embodiments, those skilled in the art will understand that variations and modifications can be effected within the scope of the invention as defined in the appended claims. Accordingly, the scope of the various embodiments of the present invention should not be limited to the above discussed embodiments, and should only be defined by the following claims and all equivalents.

I claim:

1. A reinforcement system to reinforce a load-bearing member in an existing structure, the reinforcement system comprising:

a reinforcing member having a first portion and a second portion the first portion disposed beneath the load-bearing member and having a length substantially equal to the length of the load-bearing member and a width; and the second portion having a length substantially equal to the length of the first portion and a height greater than the width of the first portion, the second portion extending substantially normal from the first portion and spaced apart from the load-bearing member, the second portion adapted to be securedly fixed in a substantially static position to support the first portion disposed beneath the load-bearing members;

wherein installation of the reinforcement member can be achieved entirely from below the load-bearing member and without modifying the existing structure.

2. The reinforcement system of claim 1, further comprising at least one vertical support member to support the reinforcing member positioned at an opposing end of the reinforcing member and disposed between the reinforcing member and a surface.

3. The reinforcement system of claim 1, wherein the first portion has a thickness greater than the second portion.

4. The reinforcement system of claim 1, further comprising a spacer disposed between the first portion and the load-bearing member.

5. The reinforcement system of claim 4, wherein the spacer has a length at least as long as the load-bearing member.

6. A method to reinforce a load-bearing member in an existing structure, the method comprising:

providing a load reinforcement member having a length approximately equal to the load-bearing member;

positioning a first portion of the load reinforcement member beneath the load-bearing member; and securedly attaching a second portion of the load reinforcement member in a spaced apart location from the load-bearing members;

wherein installation of the load reinforcement member can be achieved entirely from below the load-bearing member and without modifying the existing structure.

7. The method of claim 6, further comprising disposing a pair of vertical support members beneath the first portion of the load reinforcement member proximate opposing ends of the load-bearing member.

8. The method of claim 6, further comprising disposing a spacer between the load-bearing member and the first portion of the reinforcement member.

9. The method of claim 6, further comprising configuring the load reinforcement member such that the second portion has a height greater than a width of the first portion.

10. The method of claim 6, further comprising statically affixing the second portion of the load reinforcement member to a header, the header located proximate the load-bearing member.

11. In a structural support system to support a load above an opening in an existing structure comprising a lintel, a header proximate the lintel, and one or more vertical framing members, a reinforcement frame system to reinforce the lintel and to support the load, the reinforcement frame system comprising:

a horizontal reinforcing member having a length substantially equal to the opening, the horizontal reinforcing member comprising a first portion and a second portion;

the first portion of the horizontal reinforcing member positioned proximate the lintel to support the lintel and the load along the length of the opening;

the second portion of the horizontal reinforcing member spaced apart from the lintel and positioned proximate the header, the second portion being adapted to be securedly affixed to the header along the length of the header; and a pair of vertical support members positioned at opposing ends of the opening and disposed between the horizontal reinforcing member and a supporting surface, the vertical support members being securedly attached to at least a portion of the vertical framing members;

wherein installation of the reinforcement member can be achieved entirely from below the load-bearing member and without modifying the existing structure.

12. The system of claim 11, further comprising a spacer disposed between the first portion of the horizontal reinforcing member and the lintel along the length of the lintel.

13. The system of claim 12, wherein the second portion has a length greater than the length of the header.

14. The system of claim 13, wherein the first portion of the horizontal reinforcing member has a thickness less than about one inch and wherein the vertical support members have a thickness of less than about two inches.

15. The system of claim 14, wherein the horizontal reinforcing member has a generally "L" shaped configuration.

16. The reinforcement system of claim 1, wherein the reinforcement member is bolted to the load-bearing member.

* * * * *